US010006167B2

(12) United States Patent
Atici et al.

(10) Patent No.: US 10,006,167 B2
(45) Date of Patent: Jun. 26, 2018

(54) PILE DELIGNIFICATION

(71) Applicant: iSTANBUL TEKNIK ÜNIVERSITESI, Istanbul (TR)

(72) Inventors: Oya Atici, Istanbul (TR); Erdem Tezcan, Istanbul (TR)

(73) Assignee: ISTANBUL TEKNIK ÜNIVERSITESI, Istanbul (TR)

( * ) Notice: Subject to any disclaimer, the term of this patent is extended or adjusted under 35 U.S.C. 154(b) by 0 days. days.

(21) Appl. No.: 15/107,881

(22) PCT Filed: Aug. 10, 2015

(86) PCT No.: PCT/TR2015/050063
§ 371 (c)(1),
(2) Date: Jun. 23, 2016

(87) PCT Pub. No.: WO2016/028244
PCT Pub. Date: Feb. 25, 2016

(65) Prior Publication Data

US 2016/0326693 A1 Nov. 10, 2016

(30) Foreign Application Priority Data

Aug. 19, 2014 (TR) ..... a 2014 09682

(51) Int. Cl.
*D21C 9/08* (2006.01)
*D21C 3/02* (2006.01)
(Continued)

(52) U.S. Cl.
CPC ..... *D21C 3/02* (2013.01); *D21C 1/10* (2013.01); *D21C 9/02* (2013.01); *D21C 9/083* (2013.01); *D21C 11/0007* (2013.01)

(58) Field of Classification Search
CPC ..... D21C 3/02; D21C 3/22; D21H 11/12
See application file for complete search history.

(56) References Cited

U.S. PATENT DOCUMENTS 137,484 A * 4/1873 Routledge ..... D21C 5/005 162/72
1,510,070 A * 9/1924 Weygang ..... D21C 3/222 162/73

(Continued)

FOREIGN PATENT DOCUMENTS

WO WO 95/13419 5/1995
WO WO-2006100560 A1 * 9/2006 ..... D01C 1/04

OTHER PUBLICATIONS

Watling et al., Effectiveness of Lime Particle Size in Neutralisation of Sulfidic Acid Sulfate Soil Materials, 2010, 19th World Congress of Soil Science, Soil Solutions for Changing World.*

(Continued)

*Primary Examiner* — Anthony Calandra
(74) *Attorney, Agent, or Firm* — Hershkovitz & Associates, PLLC; Abe Hershkovitz

(57) ABSTRACT

The present invention relates to a delignification method which is applied for removing lignin from a biomaterial mixture in form of a pile, and essentially comprises the steps of piling of the biomaterials, treating the pile with an irrigation solution comprised of water or an aqueous solution comprising chemical materials, transferring the irrigation solution leached during reaching to the bottom of the pile to a pool or a storage unit with a drainage system, giving the irrigation solution which is transferred to the pool or the storage unit to irrigation again after controlling and optimizing, and leaching the pile by stopping the irrigation when the delignification process ends.

19 Claims, 1 Drawing Sheet

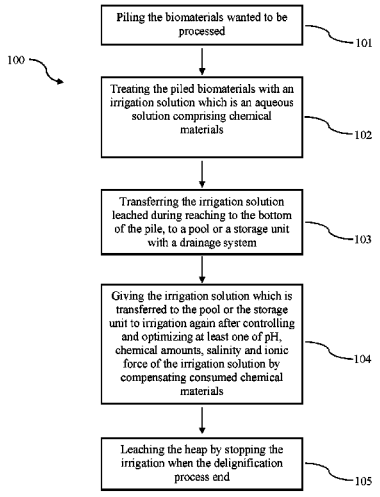

(51) Int. Cl.

| | |
|---|---|
| ***D21C 9/02*** | (2006.01) |
| ***D21C 1/10*** | (2006.01) |
| ***D21C 11/00*** | (2006.01) |

(56) References Cited

U.S. PATENT DOCUMENTS

| | | | | |
|---|---|---|---|---|
| 2,193,493 | A * | 3/1940 | Ritter | D01C 1/04 435/278 |
| 2,407,227 | A * | 9/1946 | Earle | D01C 1/04 435/279 |
| 3,802,957 | A * | 4/1974 | Cusi | B27K 5/001 162/65 |
| 5,536,366 | A | 7/1996 | Marcoccia et al. | |
| 5,662,775 | A | 9/1997 | Marcoccia et al. | |
| 5,849,151 | A | 12/1998 | Marcoccia et al. | |
| 6,203,662 | B1 | 3/2001 | Snekkenes et al. | |
| 6,346,167 | B2 * | 2/2002 | Marcoccia | 162/42 |
| 6,375,751 | B2 * | 4/2002 | Reisig | C13B 10/00 127/48 |
| 2004/0171136 | A1 * | 9/2004 | Holtzapple | C05F 5/002 435/283.1 |

OTHER PUBLICATIONS

Gullichsen editor, Chemical Pulping 6A, 1999, Fapet Oy,chapter 5.*

International Search Report dated Dec. 16, 2015, issued in PCT/TR2015/050063.

Donati ER, Sand W. Microbial processing of metal sulfides. Springer Verlag; 2007.

Fang J, Sun R, Tomkinson J. Isolation and characterization of hemicelluloses and cellulose from rye straw by alkaline peroxide extraction. *Cellulose*. 2000;7(1):87-107.

Macfarlane AL. Organosolv delignification of willow: Kinetics, recovery and use. 2009.

Silverstein RA, Chen Y, Sharma-Shivappa RR, Boyette MD, Osborne J. A comparison of chemical pretreatment methods for improving saccharification of cotton stalks. Bioresource Technology. 2007; 98(16):3000-3011.

Sun J, Sun X, Zhao H, Sun R. Isolation and characterization of cellulose from sugarcane bagasse. Polymer degradation and stability. 2004; 84(2):331-339.

* cited by examiner

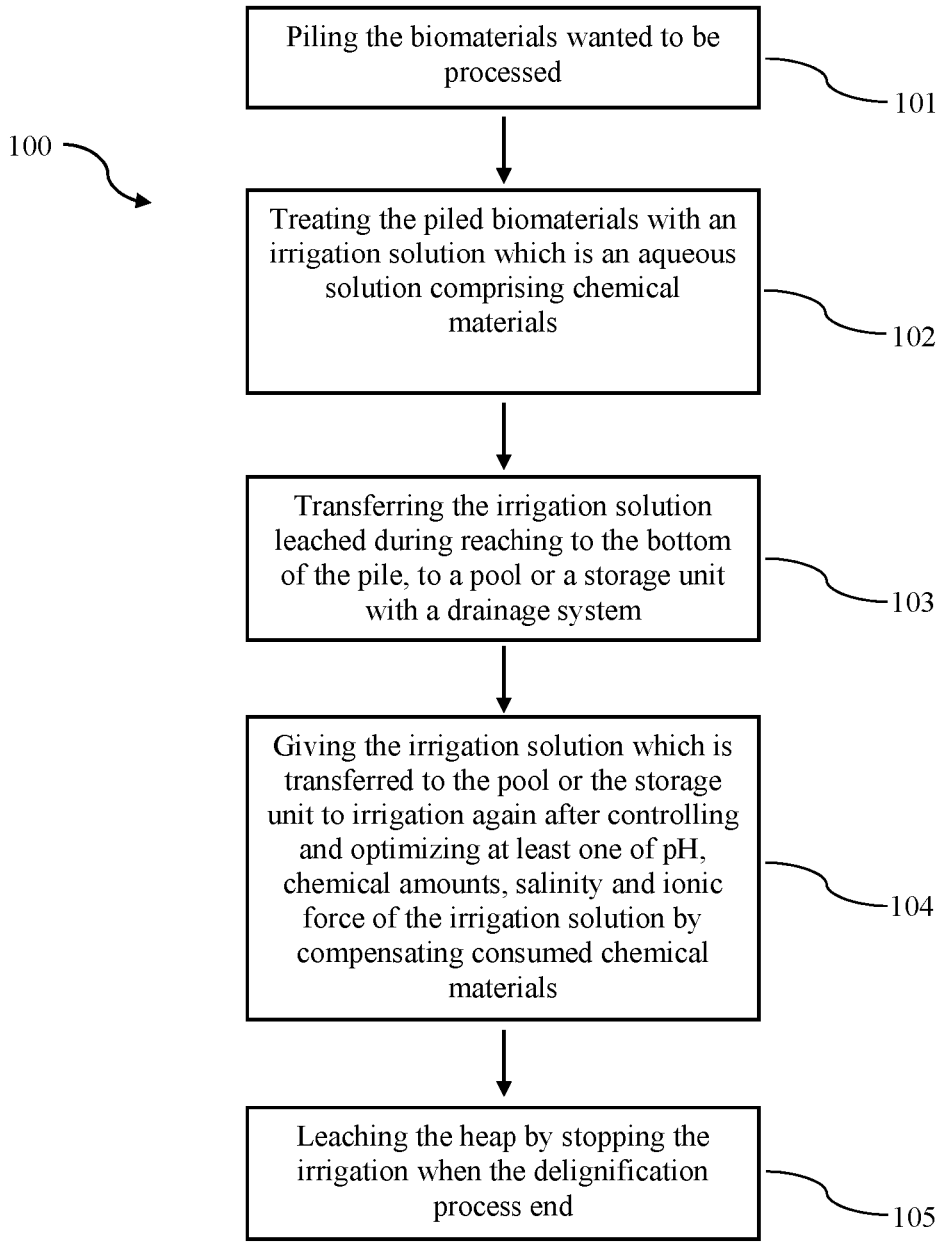
100
Piling the biomaterials wanted to be processed
101
Treating the piled biomaterials with an irrigation solution which is an aqueous solution comprising chemical materials
102
Transferring the irrigation solution leached during reaching to the bottom of the pile, to a pool or a storage unit with a drainage system
103
Giving the irrigation solution which is transferred to the pool or the storage unit to irrigation again after controlling and optimizing at least one of pH, chemical amounts, salinity and ionic force of the irrigation solution by compensating consumed chemical materials
104
Leaching the heap by stopping the irrigation when the delignification process end
105

PILE DELIGNIFICATION

FIELD OF THE INVENTION

The present invention relates to a novel delignification method which is applied for removing lignin completely or partially by irrigating of biomaterials agglomerated in a pile with chemicals.

BACKGROUND OF THE INVENTION

Cellulose is one of the most common natural vegetative biomaterials and it has great industrial importance. The chemical structure of cellulose is composed of the D-glucopyranose monomers forming linear homopolysaccharides bonded by β-(1,4) glucosidic bonds. The number of monomeric units changes according to the plant species, it is around 10 thousand in woods, and around 15 thousand in cotton. Natural cellulose is present together with hemicellulose and lignin in plant structure. For this reason, lignin and hemicellulose should be removed in order to purify cellulose.

Hemicelluloses are also a kind of polysaccharide, and they are present in plants generally in ratio of 20% by weight[1]. Hemicelluloses are obtained by extracting vegetative biomaterials with alkali solutions. Hemicelluloses have random amorphous structure and comprise many kind of polysaccharides (For example: arabinoxilanes; (1→3) and (1→4)-β-glucans, xyloglucanes, pectins and gluco- and galacto-mannans[2]). Hemicelluloses comprise much less monomeric units (100-200 units) than celluloses, and they can easily be dissolved in alkaline solutions and eluted after separation of pectic components from plants.

[1]Fang J, Sun R, Tomkinson J. Isolation and characterization of hemicelluloses and cellulose from rye straw by alkaline peroxide extraction. *Cellulose*. 2000; 7(1):87-107.

[2]Sun J, Sun X, Zhao H, Sun R. Isolation and characterization of cellulose from sugarcane bagasse. *Polymer degradation and stability*. 2004; 84(2):331-339.

Lignin is the second most common natural biomaterial. Lignins coexist with the cellulose. Functionally, they are present in the cell walls of the vascular plants and the stems of the woody plants. Lignins are quite hydrophobic contrary to the cellulose. Hemicelluloses are both hydrophilic and hydrophobic, therefore they provide compatibility between the cellulose and lignin. Lignin controls carrying water from cell wall and plant stem.

The hydrophobic structure of lignin protects the plant from enzymatic and chemical decomposition. For this reason, it makes the cellulose difficult to be reached by the chemicals or the enzymes. Furthermore, it gives a dark color to cellulose. Cellulose should as white as possible for paper industry, antimicrobial agents and enzyme inhibitors should be removed as much as possible for bioethanol production, and cellulose should be as pure as possible in production of cellulosic chemicals such as CMC (carboxymethyl cellulose). Because of all these reasons, the process of removing lignin (delignification) has great importance industrially.

Kraft (sulfite) process is one of the most important delignification processes especially in pulp and paper industry. In this method, concentrated NaOH and $Na_2S$ solutions (White liquor), high temperature, high pressure and suitable processing devices which are suitable for these hard conditions are used. The vegetative material (mostly wood) treated in these conditions is purified from lignin and hemicellulose, remaining is harmful and foul-smelling chemical mixture which is called as black liquor.

Today, new technologies are continuously sought due to environmental concerns and it is desired to obtain cellulose in more economical (operational and capital) conditions. Organosolv process is one of the new technologies realized as a product of this search. Organic solutions are used for dissolving and removing lignin and hemicellulose in Organosolv method. Generally, ethanol:water and acetone: water mixtures are used, and biomaterials are treated in these organic mixtures under high temperature (160-200° C.) and pressure. Then the biomaterial mixture is subjected to solid liquid separation and some part of the organic solvent is recovered from the liquid part. In Organosolv method, contrary to kraft process, foul-smelling waste chemicals (as waste) do not come out. Furthermore, the quality of the produced lignin has better quality relative to the one in kraft method. Apart from all these advantages, high temperature, pressure and using organic solvents in Organosolv method also increases capital and operating costs just like kraft method[3].

[3]Macfarlane A L. Organosolv delignification of willow: Kinetics, recovery and use. 2009.

Alternative delignification methods remove only some part of lignin. Especially, in bioethanol production, cellulose should be separated from lignin and hemicellulose as much as possible so that the enzymes can affect cellulose. The higher the delignification rate is, the more the bioethanol production increases. It has been shown that some part of lignin can be removed by subjecting biomaterials to several pretreatments. Silverstein et al. (2007) pretreated cotton stalks with $H_2SO_4$, NaOH, and $H_2O_2$ at concentrations of 0.5%, 1%, and 2% (w/v), 1:10 solid:liquid ratio, at 90° C. and at 121° C. under 15 psi pressure for 30, 60, and 90 minutes residence times and compared delignification ratios and glucose production yields after enzymatic hydrolysis of cellulose. They found that 2% NaOH pretreatment at 121° C./15 psi for 90 minutes gave the highest delignification ratio (65.63%) and highest cellulose conversion (60.8%)[4].

[4]Silverstein R A, Chen Y, Sharma-Shivappa R R, Boyette M D, Osborne J. A comparison of chemical pretreatment methods for improving saccharification of cotton stalks. *Bioresource Technology*. 2007; 98(16):3000-3011.

Heap leaching technology is a kind of hydrometallurgical process. Mineral stones or wastes which are crumbled and agglomerated in a heap are irrigated with various solutions, and the valuable metals such as copper or gold therein are separated in this method. During irrigation, the irrigation solution starts to solve the valuable metals while flowing towards the bottom of the heap, and it gradually gets saturated. When the solution reaches the bottom of the heap, it is transferred to the storage pool via drainage system. Then, mineral is separated from this solution if it reaches the adequate saturation. Then, the parameters of irrigation solution such as pH, chemical amount are adjusted and it is given to the irrigation again. This cycle is continued until most of the valuable metals in the mineral are separated. In heap leaching method, tens of thousands even hundreds of thousands of mineral can be processed in open air and in the field without requiring complex and expensive systems such as reactor, heat, pressure. For this reason, capital and operating expenses are much less relative to other conventional mineral separation methods. It is also possible to elongate mineral irrigation time since operating expenses are much smaller. Thus, gold and copper heaps can be irrigated for months at the heap leaching systems. Especially it is not economical to process low content mine and mine slags and wastes with other conventional methods, they become economical in heap leaching. In other words, some minerals that cannot be separated with other methods can be separated with heap leaching method.

Today, there are lots of experience about technical infrastructure of heap leaching especially in mining and metallurgy sector. Especially due to using acidic solutions (sulfuric acid) for separating copper, and using basic solutions (alkali cyanide) for separating gold, heap leaching system can be performed with both acidic and basic solutions. At the same time, it is possible to operate by giving microorganisms to the system and providing the medium where they will live. In heap bioleaching method, mostly a bacterium named *Acidithiobacillus ferrooxidans* is used. This bacterium can live in acidic conditions (acidophilic), grow at ambient temperatures (20-45° C.), and use mines such as pyrite ($FeS_2$) and chalcopyrite ($CuFeS_2$) for obtaining energy. They are naturally present in mines such as pyrite and chalcopyrite. In heap bioleaching method, this bacterium is used in iron containing mines such as pyrite and chalcopyrite, and irrigation is performed with solutions comprising ideal chemicals such that it can live in, and air is also given to the heap from the bottom via pipes. *Acidithiobacillus ferrooxidans* bacterium oxidizes bivalent iron ion to trivalent iron ion under these conditions. The formed iron ion dissolves the copper in chalcopyrite mine and passes it down to the irrigation solution[5]. In addition to the heap bioleaching technology comprising all positive aspects of the heap leaching technology, the presence of microorganisms significantly increases the reaction rates and efficiency. Furthermore, the increase in reaction rate and efficiency also allows mines, slags and wastes with lower content to be processed[6]. Heap bioleaching technology can also be used in gold mine heaps to remove iron which lowers gold yield by surrounding the gold so increasing cyanide consumption.

Smith R, Misra M, Dubel J. Mineral bioprocessing and the future. *Minerals Engineering*. 1991; 4(7-11):1127-1141.

[6]Donati E R, Sand W. *Microbial processing of metal sulfides*. Springer Verlag; 2007.

Even though heap leaching and bioleaching methods are commonly used in metallurgy and there is lots of experience, there is no study in the literature for adapting the technology to delignification.

SUMMARY OF THE INVENTION

The objective of the present invention is to provide a delignification method wherein lignin is removed completely or partially by irrigating piled biomaterials with chemicals.

Another objective of the present invention is to provide a delignification method wherein irrigation solution reaching to the bottom of the pile is transferred to a pool or storage unit with a drainage system by being leached.

A further objective of the present invention is to provide a delignification method wherein solution is given to the irrigation again after performing control and optimization in the irrigation solution transferred to the poll or storage unit, until a desired delignification rate is obtained.

DETAILED DESCRIPTION OF THE INVENTION

The flowchart of a delignification method developed to fulfill the objectives of the present invention is shown in FIG. 1.

A delignification method (100) developed to fulfill the objective of the present invention comprises the steps of:

piling the biomaterials wanted to be processed (101), treating the piled biomaterials with an irrigation solution which is an aqueous solution comprising chemical materials (102), transferring the irrigation solution leached during reaching to the bottom of the pile, to a pool or a storage unit with a drainage system (103), giving the irrigation solution which is transferred to the pool or the storage unit to irrigation again after controlling and optimizing at least one of pH, chemical amounts, salinity and ionic force of the irrigation solution by compensating consumed chemical materials (104), and leaching the piled biomaterials by stopping the irrigation when the delignification process ends (105).

In the preferred embodiment of the invention, the biomaterials wanted to be processed are cleaned before being piled (101). The barks of the tree parts in biomaterial mixture are peeled.

The cleaned biomaterials are preferably ground before being piled (101). In the preferred embodiment of the invention, they are ground such that the size of the cleaned material will be smaller than 4 cm. The system operates without grounding or in other sizes, but the product quality decreases.

The ground biomaterials are piled in pile field (101). In the preferred embodiment of the invention, the pile field is formed in a pool or in an area. Biomaterials are piled on top of each other by putting them on top of each other or putting them in big bags and/or sacks. Biomaterials can be piled directly or by mixing with lime, zeolite, microorganisms and/or other materials. There is no limitation about the width, height and length of the pile.

The pile is treated with an irrigation solution comprised of water or an aqueous solution comprising chemical materials (102). In the preferred embodiment of the invention, irrigation solution is given to the pile from the top to the bottom. Irrigation solution can be given to the system by flowing into it directly, from a sprinkler, by smoking or via another system.

In the preferred embodiment of the invention, the irrigation solution is an aqueous solution comprising at least one of the chemical materials which comprises HCl, $H_2SO_4$, $H_3PO_4$, $HNO_3$, HF, $Ca(OH)_2$, NaOH, $NaCO_3$, $NH_4OH$, $NaHCO_3$, KOH, $Mg(OH)_2$, $Na_2S$, $K_2S$, ammonium persulfate, potassium persulfate, sodium persulfate, sodium hypochlorite, sodium perborate, sodium percarbonate, hydrogen peroxide chemicals, iron, copper, aluminum or zinc metal salts. pH, osmotic pressure, salinity or conductivity features of irrigation solution are controlled with these chemical materials. Tap water, well water, sea water, oceanic water, rain water, distilled water, waste water, deionized water or other kinds of water are used for irrigation solution.

In the preferred embodiment of the invention, pH value of the irrigation solution is kept between 11 and 14 by adding NaOH or the hydroxyl [OH] ion concentration is kept between $10^{-3}$ and 1 molar values.

Irrigation solution is given directly to the pile or after passing through another material such as sand, lime, zeolite, dolomite, alumina, activated carbon or filter. In the preferred embodiment of the invention, the irrigation solution is passed through lime and then given to the pile. In this way, it gets easy to remove lignin by means of the lime which gives alkalinity to the water. The particle size of the lime material through which the irrigation solution will be passed is preferably between 0.5 mm and 5 cm. The particle size of the material can be set by pressing or grinding after being mixed with water. The process of passing through lime is performed either just before giving the solution to the pile or while the solution is being leached from the pile or in both situations. Additionally, a system may be installed such that lime will be present inside, under and/or above the pile. When it is necessary, at least one of NaOH, $NaCO_3$, $NH_4OH$, $NaHCO_3$, KOH, $Mg(OH)_2$ bases, iron, copper, aluminum or zinc metal salts, sodium sulfide, potassium sulfide, ammonium persulfate, potassium persulfate, sodium persulfate, sodium hypochlorite, sodium perborate, sodium percarbonate, hydrogen peroxide chemicals are added to the system with lime. Other natural stones (such as dolomite) or cheap materials giving alkalinity can be used instead of lime.

In the preferred embodiment of the invention, air, nitrogen, ozone or oxygen is given to the pile from the bottom in step of irrigation (102) in order to increase the reaction rate and/or quality.

In the preferred embodiment of the invention, hydrogen peroxide chemical ($H_2O_2$) is given on the pile or into the irrigation solution in step of irrigation (102) in order to increase the reaction rate and/or quality.

The irrigation solution reaching to the bottom of the pile is transferred to a pool or a storage unit with a drainage system by being leached (103).

The irrigation solution which is transferred to the pool or the storage unit is given to irrigation again after controlling and optimizing (104). This optimization comprises processes such as pH, chemical amounts, salinity and ionic force control; separating hemicellulose, lignin or other components. The cleaned solution is given to the irrigation again (104) after the lignin and hemicellulose passing to the irrigation solution are held with the filter; in the meantime the lignin and hemicellulose are also purified. In the preferred embodiment of the invention, delignification rate is observed once a day optimally. Irrigation is stopped and the pile is leached (105) when the delignification process ends. Delignification process can be stopped when the chemical material consumption stops or the delignification rate decreases. Leaching process occurs by itself without needing any filtering apparatus. The solution at the end of the process can be given to a new pile, cleaned, or can be used as fertilizer or one of the components of the fertilizer.

In the preferred embodiment of the invention, pile is washed with water after the leaching process ends. Washing process and washing number are adjusted according to the desired quality and the economic data.

The product is dried after washing ends. In the preferred embodiment of the invention, the product is dried in open air. In case it rains during drying process in open air, necessary precautions are taken.

When the delignification process ends, it is possible to apply this method (100) preferably on the cellulose remaining in the pile or to apply the method (100) for carboxymethylcellulose and/or bioethanol conversion through the cellulose. In case this method (100) is applied for carboxymethylcellulose and/or bioethanol conversion, washing and drying steps are skipped or washing number is decreased. Furthermore, irrigation is continued with chemicals (for example CMC for chloroacetic acid and NaOH) required for these conversions. In conversions which make the cellulose soluble, cellulose is removed from the system by holding with filter or with other separation methods after the cellulose is dissolved. It is also possible to run delignification and the cellulose at the same time.

The inventive delignification method (100) can be used as a delignification process completely or it can be used as a pre-treatment or intermediate treatment for more advanced delignification systems.

In the inventive pile delignification method, heap leaching technology is adapted to the delignification for the first time, and many advantages have been acquired in terms of economy, environment, quality and safety.

In the inventive pile delignification method, it is possible to grind and pile, and process tens of thousands even hundreds of thousands tons of material in open air just like a pile leaching system applied in metallurgy. The biomaterials to be piled can be of single type as well as it is possible to pile various kinds of biomaterials mixed in the same field or separate sacks or bigbags. A high capacity pile field can be formed without using reactors resistant to high pressure and chemicals. Capital cost of creating such pile field is much lower than other methods performing in the same capacity, and obtaining the devices is also much easier. Operating costs are much less because of absence of high energy consumption cost required for generating high temperature and pressure, safety and flue gas precautions costs of other systems.

In the inventive pile delignification method, the processed products are washed until they reached desired cleanness, the washing water is leached and finally it is dried in open air. In this method, there is no need for separate equipment since the solution is leached by itself. The practicality of filtering allows more washing filtering steps which increases the quality. However, in other methods such as kraft and organosols, since the delignification solution is hot, pressurized and foul-smelling, it is filtered with special equipments requiring high capital and operating costs, and it is dried in drying furnaces, and separate place is needed for all these equipments.

The inventive pile delignification method has low risk since it does not comprise the step of bringing the irritant chemicals to high temperature and pressure. The lower risk of the system also decreases the safety precaution costs and insurance costs.

In kraft process wherein pressurized cooking reactor is used and reaction time is a couple of hours, operating costs increase and the quality of cellulose decreases by elongating the cooking time a little. The inventive pile delignification runs much slower than the other methods, therefore it is easier to control the system and interfere with it. For example, whether enough delignification is achieved in the pile found in open area is understood with daily analyses and the system can be stopped.

In the inventive pile delignification method, when lignin, hemicellulose or another chemical (such as drug raw material) is wanted to be separated from the system, another filter or separation system can be installed after the storage pool, therefore these components can be taken from the system and purified as soon as they are separated. This application is not used in pressurized cooking systems since it is not convenient economically. Furthermore, in pressurized cooking methods, it is waited for whole reaction time ends to separate these components, and high temperature and pressure decompose these compounds. In a pile delignification method, the products can be obtained in desired quality without decomposition.

After separating cellulose from lignin as much as possible, it is possible to convert in to other chemicals such as CMC (carboxymethyl cellulose) in the same system with the same advantages. By adding microorganisms degrading the lignin naturally to the system, it is possible to operate the system as pile biodelignification. Other products such as bioethanol and fertilizer, can be obtained by adding cellulose transforming microorganisms to the system after cellulose is obtained or to the system directly without delignification.

It is required to get environment permissions while establishing facilities. Environmental damage is high at other methods releasing high temperature, pressure, corrosive chemicals and bad smelling waste. For environmental permissions, It is obligatory to make systems preventing these damages in facilities to be established newly and to make these transformations in old facilities. The inventive pile delignification method has less danger relative to other methods environmentally. Therefore, an environmentally friendly system is installed and environmental permissions can be obtained easily.

Since the inventive pile delignification method runs slow, diluted chemicals are used and adjustments are made such that it will be compensated as the chemicals are consumed by the system contrary to the other methods. Therefore, especially if smell generating chemicals are wanted to be used, the smell to be released by the system to the environment is much lower.

Since the steps of irritant and toxic chemicals being treated at high temperature and pressure are not present, the safety of the inventive pile delignification method is much higher relative to other systems. The importance of human life is invaluable and the risk of occupational accidents in such system is very low.

The invention claimed is:

1. A delignification method for removing lignin from a biomaterial mixture which is in form of a pile, comprising:

piling biomaterials in open air, treating the piled biomaterials with an irrigation solution which is an aqueous solution comprising chemical materials at atmospheric temperature and atmospheric pressure, wherein the irrigation solution comprises at least one of the chemical materials: ammonium persulfate, potassium persulfate, and sodium persulfate, transferring the irrigation solution leached during reaching to the bottom of the pile, to a pool or a storage unit with a drainage system, recirculating the irrigation solution which is transferred to the pool or the storage unit to the piled biomaterials again after controlling and optimizing at least one of pH, chemical amounts, salinity and ionic force of the irrigation solution by compensating consumed chemical materials, and leaching the piled biomaterials by stopping the irrigation when the delignification process ends.

2. The delignification method according to claim 1, wherein the biomaterials wanted to be processed are piled after they are cleaned.

3. The delignification method according to claim 2, wherein the biomaterials wanted to be processed are piled after they are ground.

4. The delignification method according to claim 3, wherein the cleaned biomaterials are ground such that the grounded biomaterial will be smaller than 4 cm in all dimensions.

5. The delignification method according to claim 1, wherein piling the biomaterials takes place where a pile field is formed in a pool or in an area.

6. The delignification method according to claim 5, wherein the biomaterials are piled on top of each other or into bags and sacks.

7. The delignification method according to claim 6, wherein the biomaterials are one of, (a) piled directly or (b) piled by mixing at least one of, (i) zeolite and (ii) microorganism in between them.

8. The delignification method according to claim 1, wherein the irrigation solution is given to the pile by flowing directly from top of the pile to the bottom, from a sprinkler.

9. The delignification method according to claim 8, wherein the water used for irrigation solution is tap water, well water, sea water, oceanic water, rain water, waste water, distilled water, deionized water.

10. The delignification method according to claim 8, wherein treating the pile with irrigation solution is done in order to increase one of, the rate and quality of the reaction and wherein air, nitrogen, ozone or oxygen is given to the pile from the bottom, or hydrogen peroxide chemical ($H_2O_2$) is given onto the pile or into the irrigation solution.

11. The delignification method according to claim 1, wherein the recirculating of the solution which is cleaned to the irrigation again after lignin and hemicellulose passing to the irrigation solution transferred to pool or storage unit are held with filter and purified.

12. The delignification method according to claim 1, wherein the pile is washed with water at least once and dried after the leaching of the pile.

13. The delignification method according to claim 12, wherein the pile is dried in open air.

14. The delignification method according to claim 12, wherein the delignification ratio is observed once a day.

15. The delignification method according to claim 1, wherein the solution, obtained in the step of leaching the pile by stopping the irrigation when the delignification process ends, is given to a new pile, cleaned or used as fertilizer or one of the components of the fertilizer.

16. The delignification method according to claim 1, wherein the method is applied on a cellulose remaining in the pile after the delignification process ends.

17. The delignification method according to claim 1, wherein the method is applied on the cellulose remaining in the heap after the delignification process ends pile for carboxymethylcellulose and/or bioethanol conversion.

18. The delignification method according to claim 13, wherein the cellulose is held with a filter and removed from the system in conversions which make the cellulose soluble.

19. A delignification method for removing lignin from a biomaterial mixture which is in form of a pile, comprising:

piling biomaterials in open air wherein the biomaterials are in bags or sacks, treating the piled biomaterials with an irrigation solution which is an aqueous solution comprising chemical materials at atmospheric temperature and atmospheric pressure, wherein the irrigation solution comprises at least one of the chemical materials: NaOH, $Na_2CO_3$, $NH_4OH$, $NaHCO_3$ KOH, $Mg(OH)_2$, $Na_2S$, $K_2S$, ammonium persulfate, potassium persulfate, sodium persulfate, sodium hypochlorite, sodium perborate, sodium percarbonate, and hydrogen peroxide chemicals, transferring the irrigation solution leached during reaching to the bottom of the pile, to a pool or a storage unit with a drainage system, recirculating the irrigation solution which is transferred to the pool or the storage unit to the piled biomaterials again after controlling and optimizing at least one of pH, chemical amounts, salinity and ionic force of the irrigation solution by compensating consumed chemical materials, and leaching the piled biomaterials by stopping the irrigation when the delignification process ends.

* * * * *